US007717679B2

(12) United States Patent
He

(10) Patent No.: US 7,717,679 B2
(45) Date of Patent: May 18, 2010

(54) STRUCTURE OF BALANCING FAN

(75) Inventor: Ping-Tsang He, Hsin-Chuang (TW)

(73) Assignee: Asia Vital Components Co., Ltd., Kaohsiung (TW)

( * ) Notice: Subject to any disclaimer, the term of this patent is extended or adjusted under 35 U.S.C. 154(b) by 719 days.

(21) Appl. No.: 11/519,395

(22) Filed: Sep. 13, 2006

(65) Prior Publication Data

US 2008/0063526 A1 Mar. 13, 2008

(51) Int. Cl.
*F01D 5/02* (2006.01)

(52) U.S. Cl. ..... 416/144; 416/190

(58) Field of Classification Search ..... 416/144, 416/190

See application file for complete search history.

(56) References Cited

U.S. PATENT DOCUMENTS 414,642 A * 11/1889 Herrick ..... 74/570.2
1,314,005 A * 8/1919 Louden ..... 74/570.2
2,795,126 A * 6/1957 Sisson ..... 68/12.23
3,696,688 A * 10/1972 Goodrich et al. ..... 74/570.2
5,256,037 A * 10/1993 Chatelain ..... 416/5
5,829,318 A * 11/1998 Hannah et al. ..... 74/570.2
6,119,547 A * 9/2000 Goransson et al. ..... 74/572.4
7,305,905 B2 * 12/2007 Rocky et al. ..... 416/190
2005/0249596 A1 * 11/2005 Hsieh ..... 416/144

* cited by examiner

*Primary Examiner*—Igor Kershteyn

(57) ABSTRACT

A structure of a balancing fan is disclosed. The fan comprises a hub and a rotation balancing unit. The hub comprises a top portion and a ring portion disposed around the top portion. A plurality of blades extends from the hub. The rotation balancing unit is disposed among the outer side of the top portion and the inner side of the ring portion and comprises a guiding portion and at least one movable weight member. The movable weight member is positioned on the inner side of the guiding portion such that the movable weight member can move along the guiding portion when the hub rotates to provide the dynamic-balance effect and thereby stabilize the rotation of the fan.

6 Claims, 10 Drawing Sheets

STRUCTURE OF BALANCING FAN

BACKGROUND OF THE INVENTION

1. Field of Invention

The present invention generally relates to a structure of a balancing fan, and more particularly to a structure of a fan capable of dynamically balancing rotation of the fan.

2. Description of Related Art

Referring to FIG. 1, the rotation of the fan 21 is not stable due to the manufacturing process, for example, formation of different sizes of the blades 22 and the differential thickness of the hub. These factors directly affect the rotation of the fan 21. Thus, not only the operation noise is increased but also the rotation efficiency is limited. This may even cause damage to the fan itself.

To overcome the above defects, some proposed a hub equipped with a ring side and a top side. The ring side has an upper flange and a lower flange, a lower side and an inner side. The ring side has a plurality of holes aligned correspondingly, and an axle is jointed to the top side. A plurality of blades is disposed around the outer side of the ring side. At least one weight block is securely positioned in the corresponding hole. Thus, the non-uniform weight distribution caused by the different sizes of the blades 22 may be overcome. The weight block is securely positioned in the hole of the lighter part to balance the whole weight of the fan for stabilizing the rotation of the fan.

However, the above conventional fan has the holes on the ring side correspondingly, the blades of the fan may have different sizes and the holes may not be positioned corresponding to the lighter blades, and therefore a weight block may be required to be disposed on the lighter side of the fan. Thus, the overall weight of the fan may be over-weighted or insufficient. The user may have to redo the weighing work for effectively using the weight block to overcome the problems due to non-uniform weight distribution, and thus this scheme is substantially unpractical.

Accordingly, in the view of the foregoing, how to balance and stabilize the rotation of the fan is an important issue for manufacturers in the field.

SUMMARY OF THE INVENTION

To overcome the above defects of the conventional art, the present invention provides a structure of a fan. The fan comprises a hub equipped with a rotation balancing unit. The rotation balancing unit comprises a guiding portion with a movable weight member such that the movable weight member moves along with the guiding portion while the hub rotates to balance the rotation of the fan.

According to an aspect of the present invention, the non-uniform weight distribution of the fan can be compensated using the movable weight member during the rotation without requiring the weight member.

According to another aspect of the present invention, the weight distribution of the fan is controlled to provide the dynamic balance to the rotation of the fan.

The fan according to another embodiment of the present invention comprises a hub and a rotation balancing unit. The hub has a top portion and a ring portion. The ring portion is positioned around the top portion. The rotation balancing unit is positioned among the outer side of the top portion and the inner side of the ring portion and has a guiding portion and at least one movable weight member. The movable weight member is positioned on the inner side of the guiding portion such that the movable weight member can move along the guiding portion when the hub rotates to provide a dynamic balancing effect to the rotation of the fan.

BRIEF DESCRIPTION OF THE DRAWING

For a more complete understanding of the present invention, reference will now be made to the following detailed description of preferred embodiments taken in conjunction with the following accompanying drawings.

DESCRIPTION OF THE INVENTION

Figure 1:
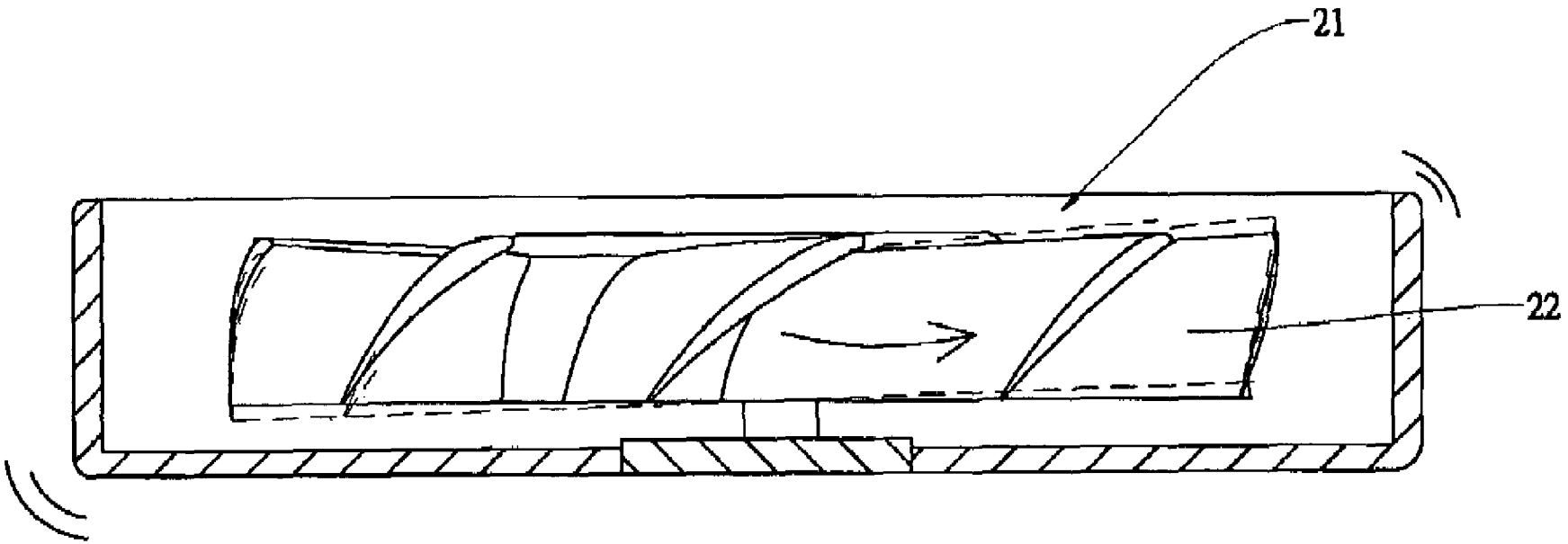
FIG. 1(PRIOR ART)
FIG. 1 is a sectional side view showing the rotation of the conventional fan.
Figure 2:
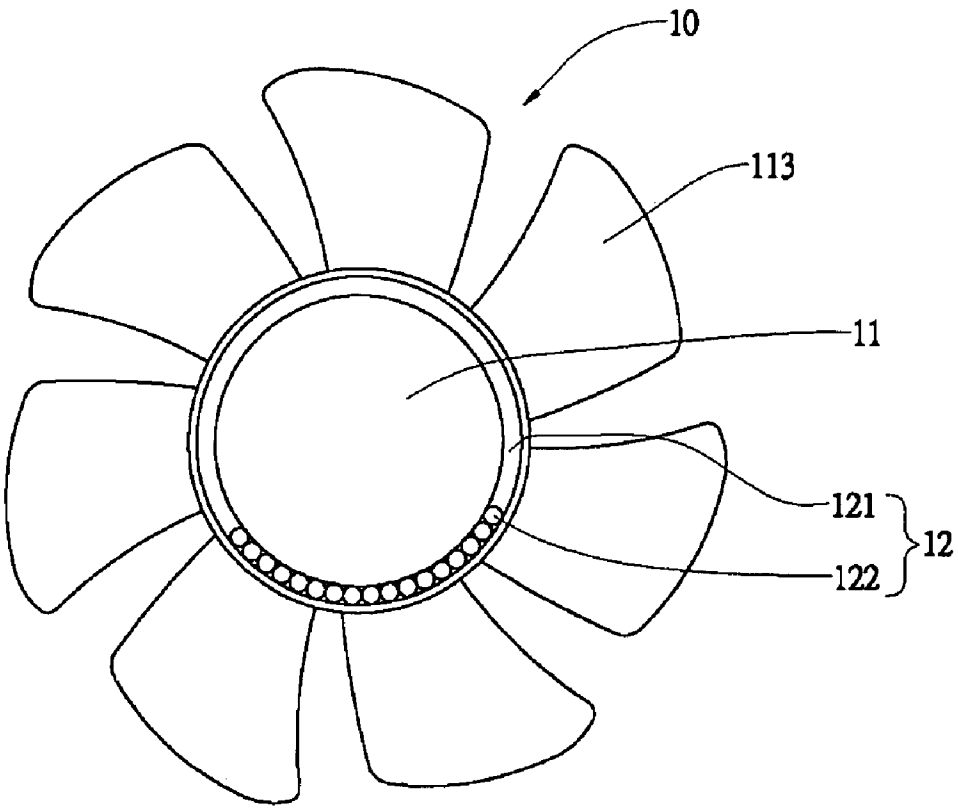
FIG. 2 is a top view of a fan according to a preferred embodiment of the present invention.
Figure 3:
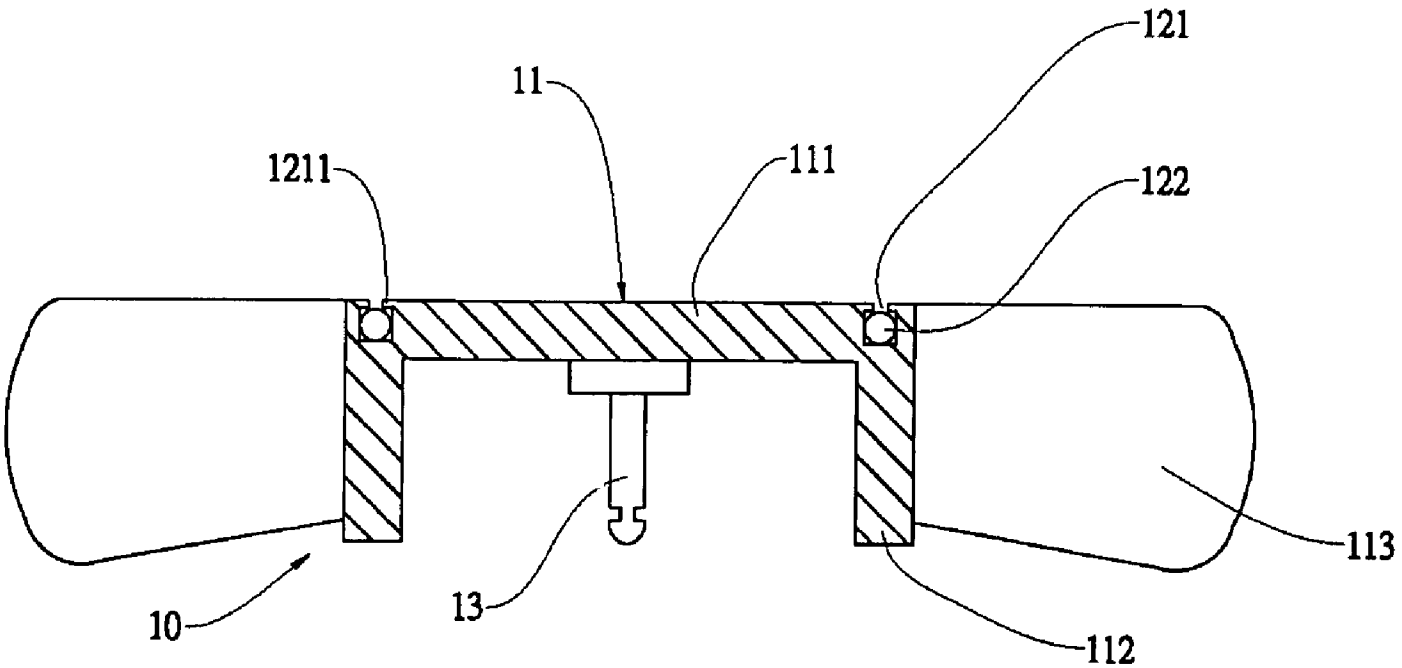
FIG. 3 is a sectional side view of a fan according to a preferred embodiment of the present invention.

Referring to FIGS. 2 and 3, the fan 10 comprises a hub 11 and a rotation balancing unit 12. The hub 11 comprises a top portion 111 and a ring portion 112. The ring portion 112 is positioned around and jointed to the top portion 111. The ring portion 112 comprises a plurality of blades 113 extending outwardly from the outer side thereof.

The rotation balancing unit 12 is positioned among the top portion 111 and the ring portion 112. The rotation balancing unit 12 is positioned on the outer side of the top portion 111 as shown in the figure. The rotation balancing unit 12 comprises a guiding portion 121 and a movable weight member 122. The guiding portion 121 is positioned continuously along the inner side of the top portion 111. The guiding portion 121 in the present embodiment is comprised of a groove. The guiding portion 121 has one indented side facing the top portion 111 and an elastic hook 1211 formed on another side thereof. The above structure and features are merely for purpose of demonstrating the embodiment of the present invention and is not intended for limiting the scope of the present invention. The opening of the groove may be sealed by a cap (not shown). The movable weight member 122 is positioned in the guiding portion 121. The movable weight member 122 in the present embodiment may be but no limitedly comprised of a roller ball. Alternatively, the movable weight member 122 may be comprised of a plurality of small sized beads, such as pellets, powder, or liquid.

Figure 4:
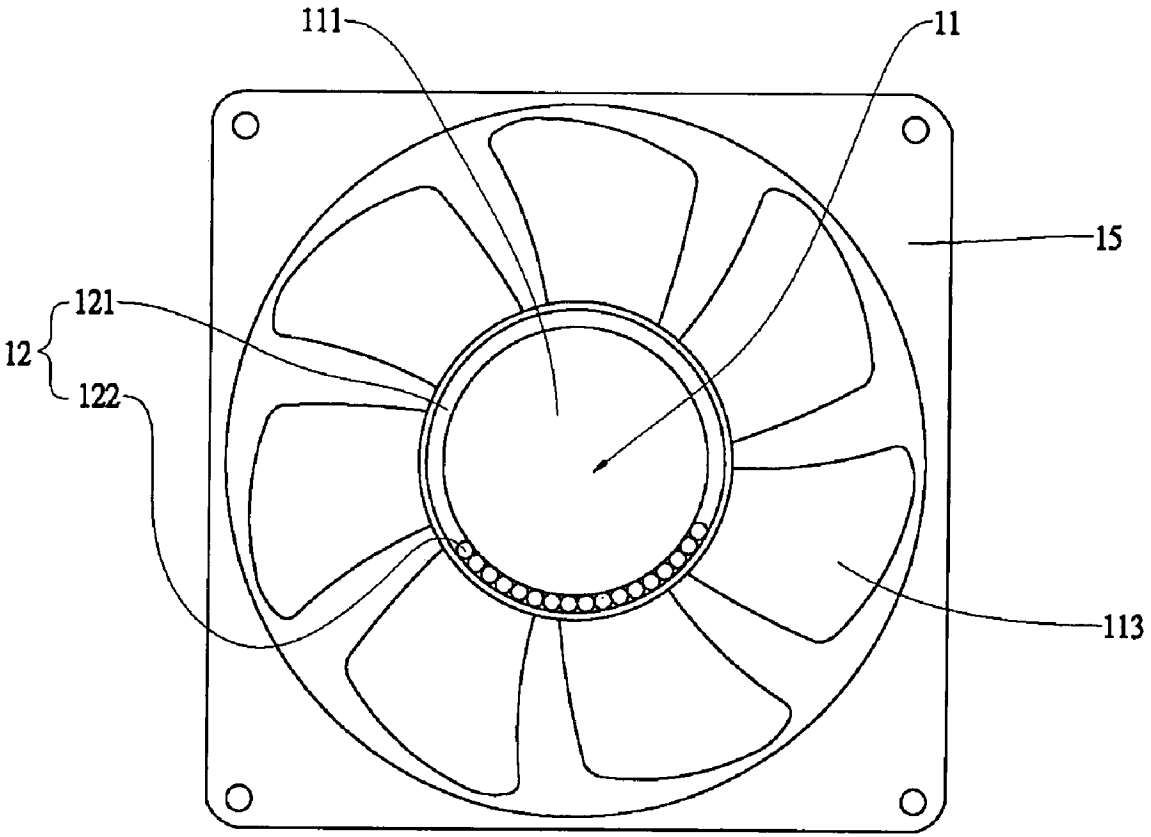
FIG. 4 is view showing the installation of the fan into the frame according to a preferred embodiment of the present invention.
Figure 5:
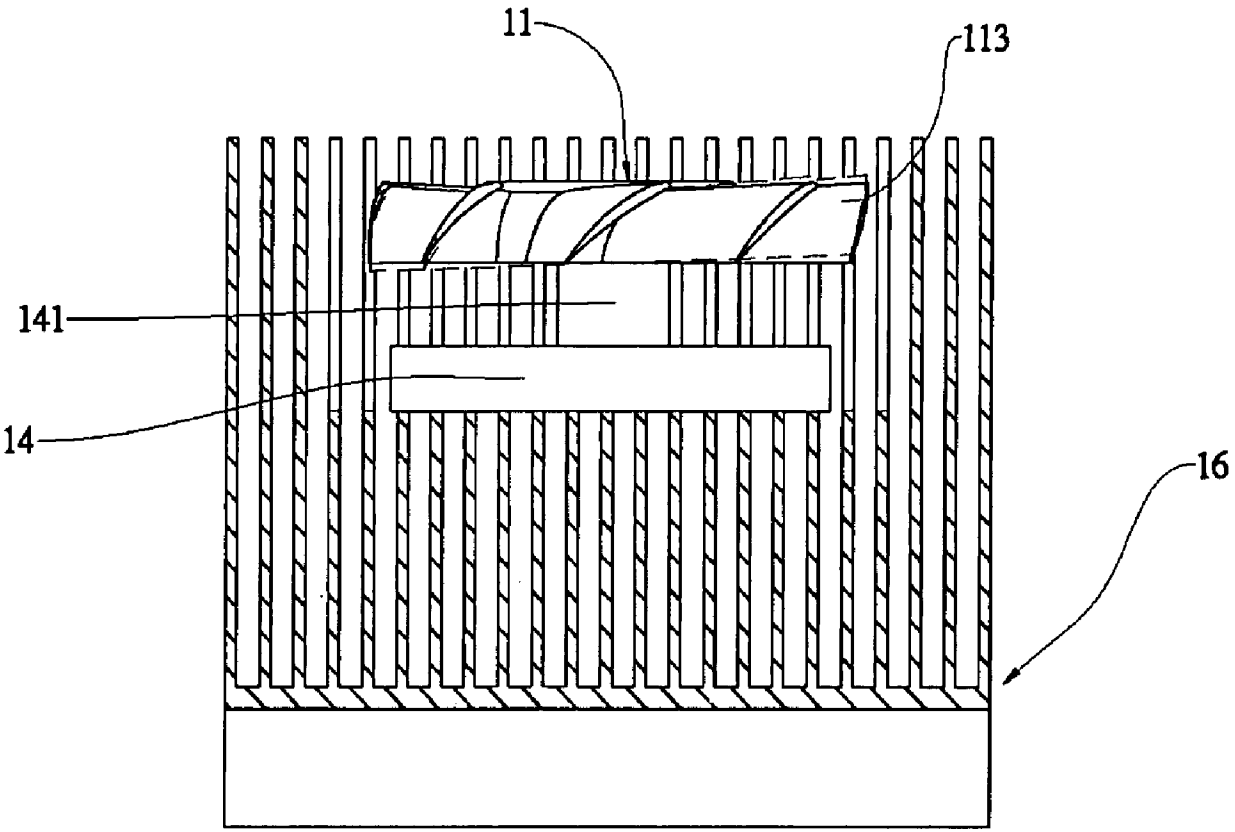
FIG. 5 is a view showing the installation the fan on the radiator according to a preferred embodiment of the present invention.
Figure 6:
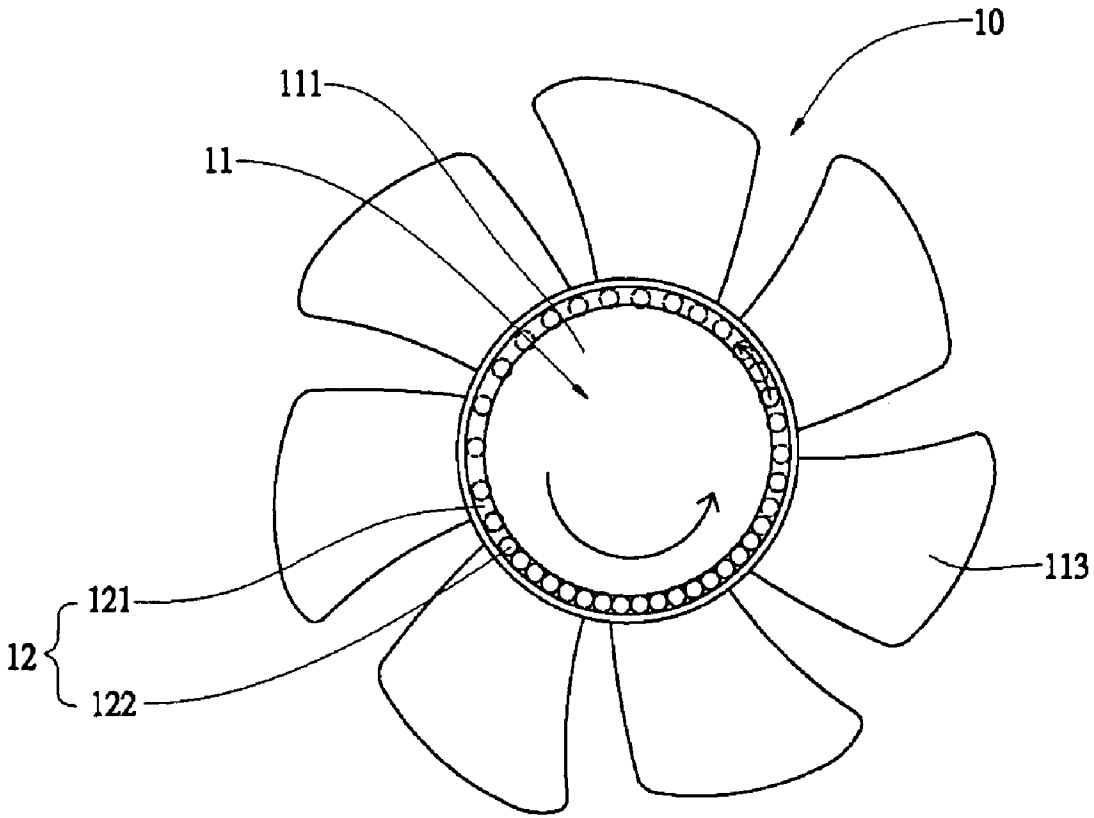
FIG. 6 is a top view showing the operation of the fan according to a preferred embodiment of the present invention.
Figure 7:
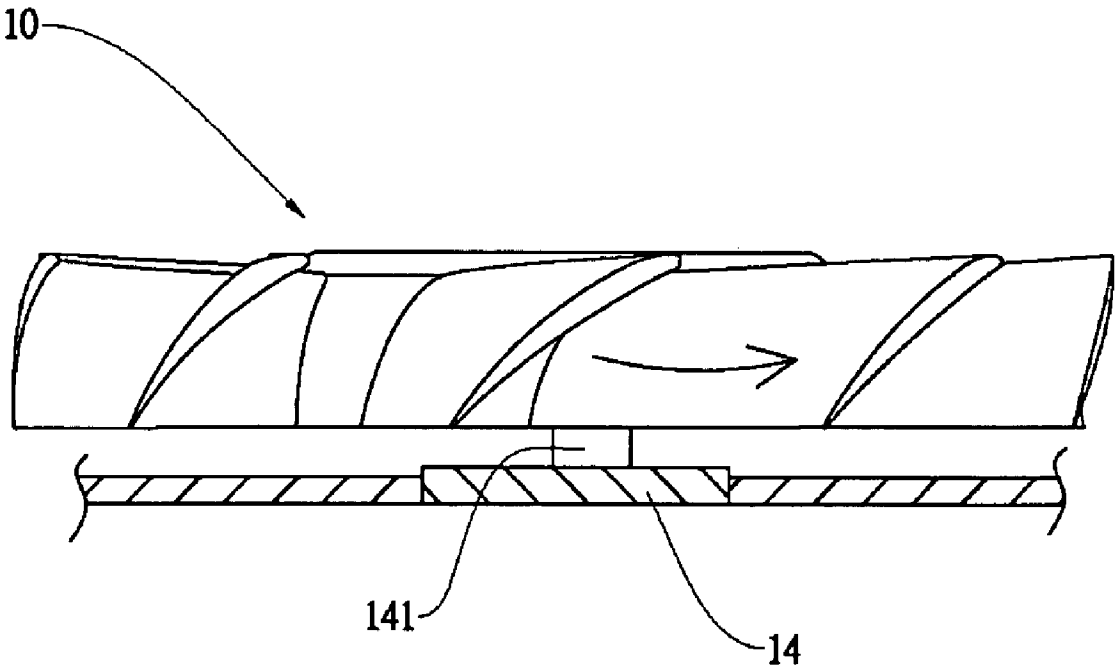
FIG. 7 is a sectional side view showing the operation of the fan according to a preferred embodiment of the present invention.

An axle 13 is connected to the inner sidewall of the top portion 111 of the fan 10, and the axle 13 is fitted into an axial sleeve 141 of the base 14, as shown in FIG. 7. Thus, the fan 10 can be axially and movably positioned on the base 14. The base 14 may be connected in the frame 15, as shown in FIG. 4, or the base 14 may be connect to the radiator 16, as shown in FIG. 5. Referring to FIGS. 6 and 7, when the fan 10 rotates, the movable weight member 122 rotates or moves along with the rotation of the hub 11 and the guiding portion 121. Thus, when the hub 11 rotates, the movable weight member 122 rotates or moves in the guiding portion 121 such that the weight of the movable weight member 122 may be evenly distributed on the hub 11 and thereby overcome the problem of the non-uniform weight distribution of the fan. Thus, the rotation of the fan 10 may be stabilized. In other words, the problems such as vibration or noise due to non-uniform weight distribution of the fan 10 may be effectively overcome by using the movable weight member 122 of the present invention, wherein the movable weight member 122 rotates or moves in the guiding portion 121 such that the weight of the movable weight member 122 may be evenly distributed on the hub 11 providing dynamic balance for stabilizing the operation of the fan 10. Thus not only the noise is reduced but also the problems due to non-uniform weight distribution can be overcome.

Figure 8:
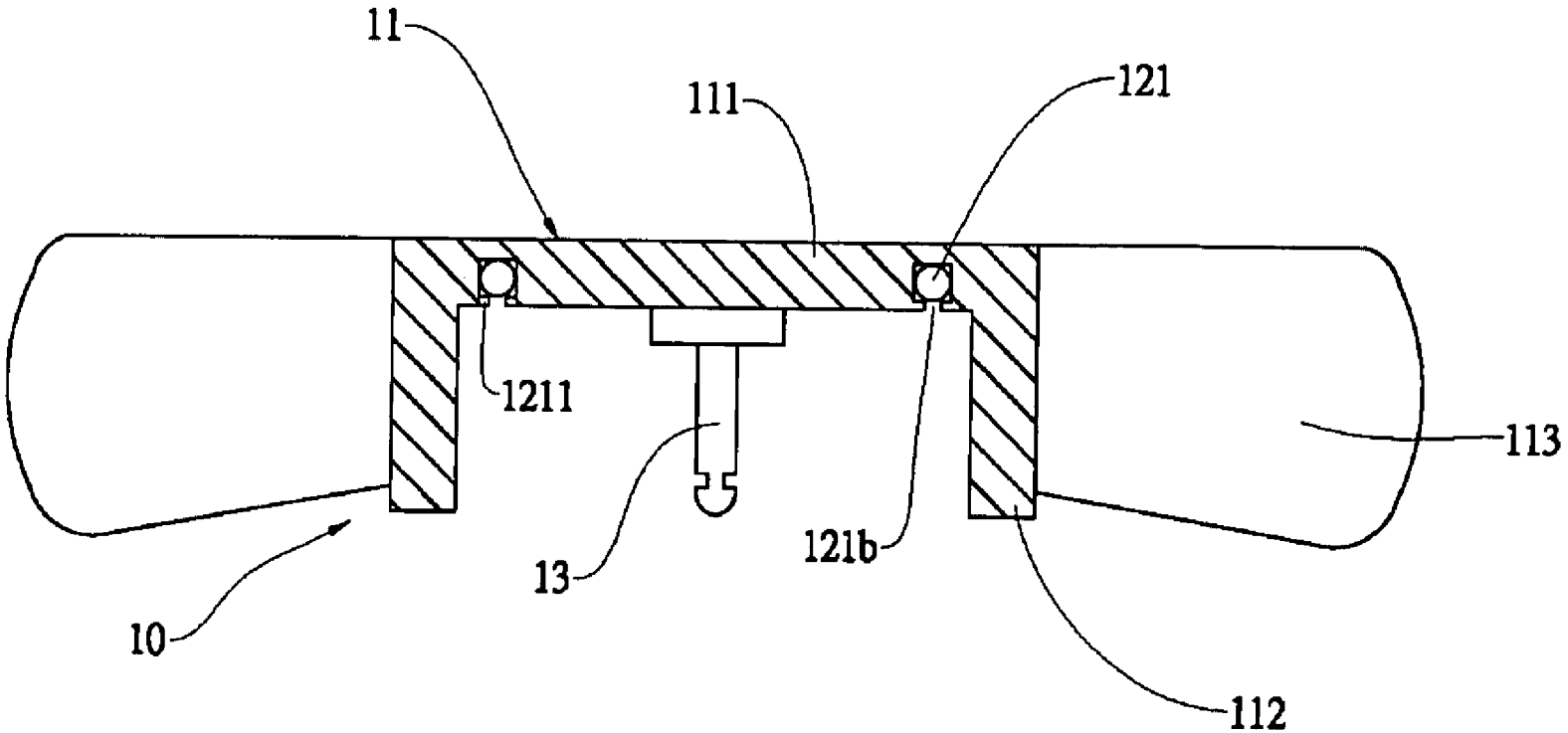
FIG. 8 is a view showing a guiding portion according to a preferred embodiment of the present invention.
Figure 9:
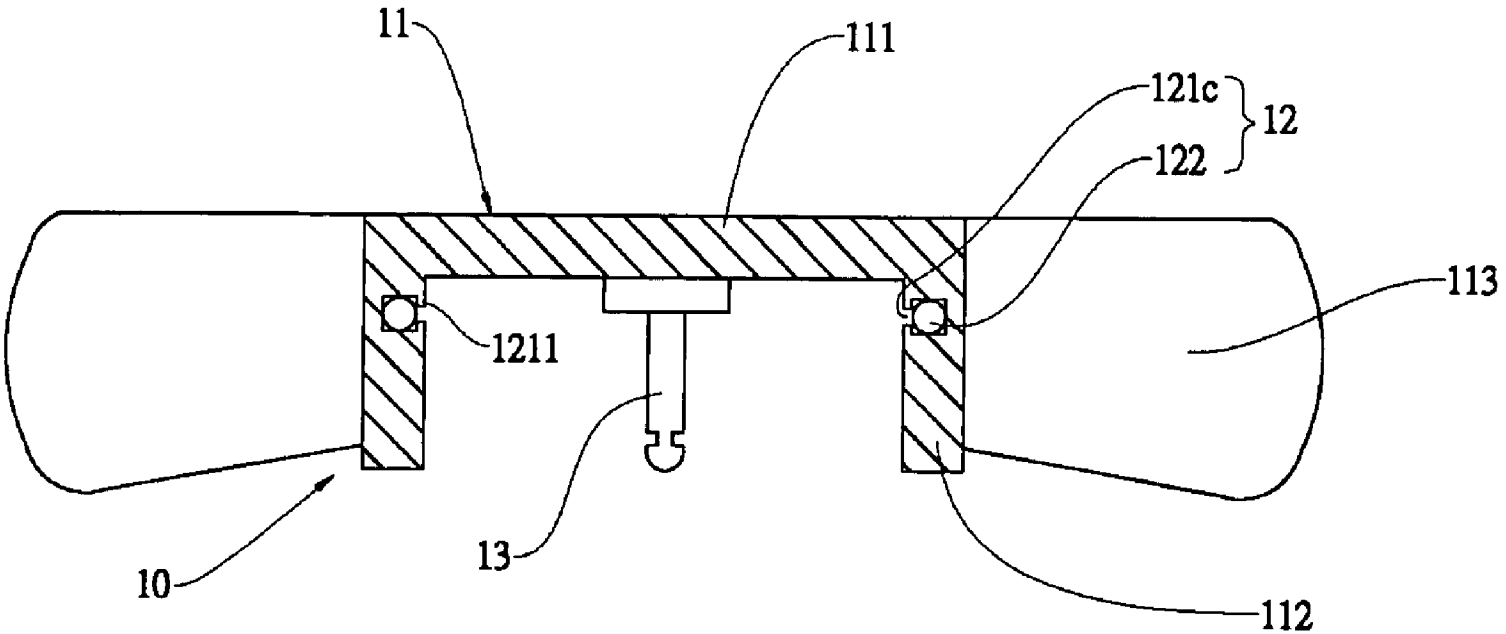
FIG. 9 is a view of a guiding portion according to another preferred embodiment of the present invention.

The guiding portion 121 is positioned on the outer side of the top portion 111, but the positioning of the guiding portion 121 is not limited thereto. Alternatively, the guiding portion 121*b* may also be positioned along the inner sidewall of the top portion 111 as shown in FIG. 8. Alternatively, the guiding portion 121*c* may also be positioned along the inner sidewall of the ring portion 112 as shown in FIG. 9.

Figure 10:
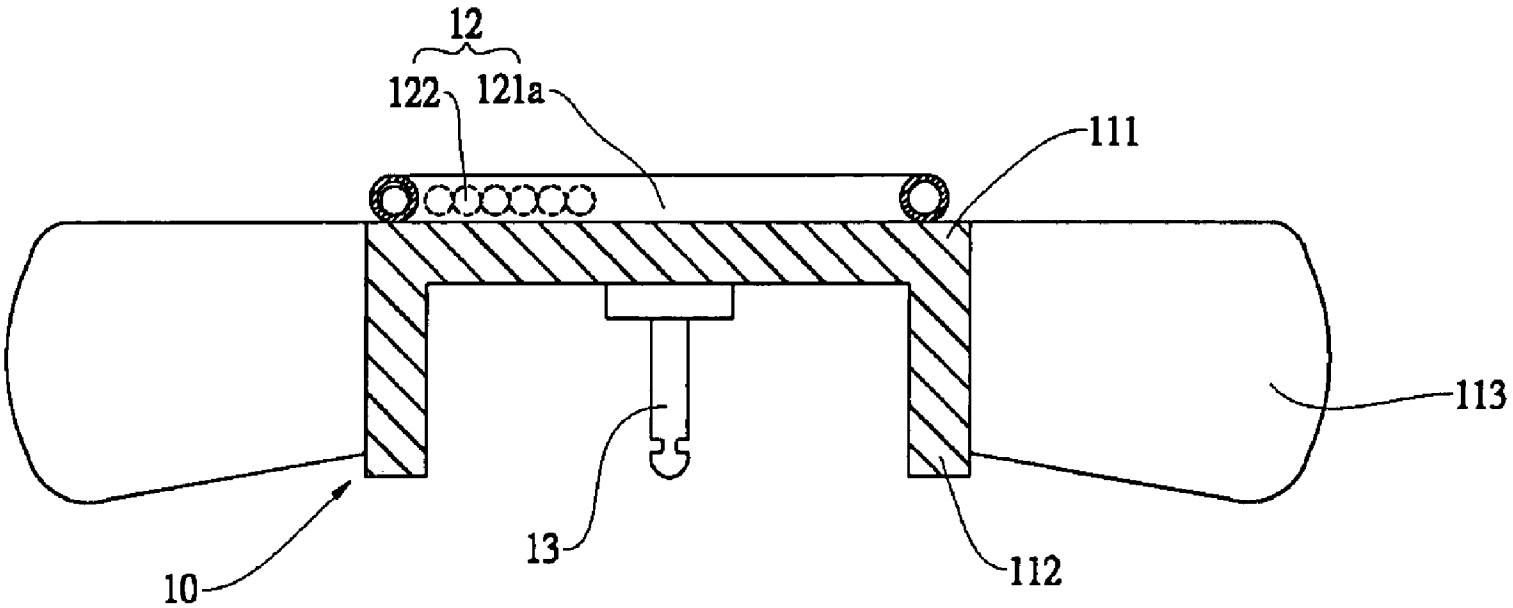
FIG. 10 is a view showing a guiding portion according to yet another preferred embodiment of the present invention.

Referring to FIG. 10, the above guiding portion 121*a* can be a guiding sleeve positioned on the outer sidewall of the top portion 111 of the hub 11, and the guiding sleeve may enclose the movable weight member 122. The movable weight member 122 may move along in the guiding sleeve.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

The invention claimed is:

1. A structure of a balancing fan comprising a hub providing a top portion, which has a first inner side and an outer side, and a ring portion, which has a second inner side, positioned around said top portion; and a rotation balancing unit disposed at said top portion or said ring portion, and further comprising a guiding portion and a movable weight member, wherein said guiding portion is a continuous circular shaped groove with an indented side and an opening side with an elastic hook at said opening side and said movable weight member is positioned in said guiding portion to rotate along with rotation of said hub.

2. The structure with a balancing fan according to claim 1, wherein said guiding portion is positioned at said first inner side or said outer side next to said ring portion.

3. The structure of a balancing fan according to claim 1, wherein said guiding portion is positioned at said second inner side next to said first inner side.

4. The structure of a balancing fan according to claim 1, wherein said an opening is sealed by a sealing cap.

5. The structure of a balancing fan according to claim 1, wherein said movable weight member is at least a roller ball or a plurality of pellets.

6. The structure of a balancing fan according to claim 1, wherein said movable weight member is a powder or a liquid.

* * * * *